US012055086B2

(12) United States Patent
Fukuda et al.

(10) Patent No.: US 12,055,086 B2
(45) Date of Patent: Aug. 6, 2024

(54) ENGINE

(71) Applicant: Yanmar Holdings Co., Ltd., Osaka (JP)

(72) Inventors: Yasushi Fukuda, Osaka (JP); Yuki Kobayashi, Osaka (JP); Masato Nishino, Osaka (JP)

(73) Assignee: YANMAR HOLDINGS CO., LTD., Osaka (JP)

( * ) Notice: Subject to any disclaimer, the term of this patent is extended or adjusted under 35 U.S.C. 154(b) by 0 days.

(21) Appl. No.: 18/111,432

(22) Filed: Feb. 17, 2023

(65) Prior Publication Data

US 2023/0265779 A1 Aug. 24, 2023

(30) Foreign Application Priority Data

Feb. 18, 2022 (JP) ..... 2022-023514

(51) Int. Cl.
*F01P 11/06* (2006.01)
*F01P 11/04* (2006.01)

(52) U.S. Cl.
CPC ..... *F01P 11/06* (2013.01); *F01P 11/04* (2013.01)

(58) Field of Classification Search
CPC ..... C23F 13/06; F01P 11/04
See application file for complete search history.

(56) References Cited

U.S. PATENT DOCUMENTS 4,562,697 A 1/1986 Lawson
6,575,199 B1 * 6/2003 Ueda ..... F02D 33/003 138/137
2004/0061332 A1 * 4/2004 Takayanagi ..... F16L 37/0847 285/330
2010/0247947 A1 * 9/2010 Tamura ..... B32B 1/08 428/586
2011/0109080 A1 * 5/2011 Christensen ..... F16L 25/12 285/32
2012/0126528 A1 * 5/2012 Christensen ..... F16L 25/12 285/302
2012/0291903 A1 * 11/2012 Ekelund ..... B29C 53/805 138/97
2014/0116668 A1 * 5/2014 Maniar ..... F28F 1/426 165/181

(Continued)

FOREIGN PATENT DOCUMENTS

CN 110425030 A 11/2019
JP 353032247 U 3/1978

(Continued)

OTHER PUBLICATIONS

European Search Report dated Jun. 23, 2023 issued in EP Application No. 23155715.8.

*Primary Examiner* — Long T Tran
(74) *Attorney, Agent, or Firm* — NORTON ROSE FULBRIGHT US LLP

(57) ABSTRACT

An engine includes a sacrificial protective pipe subjected to a sacrificial protective coating process, and a metal pipe connected to at least one of two ends of the sacrificial protective pipe. The engine includes a flow path component (an intercooler side cover, a fresh-water cooler side cover) connected to one of two ends of the metal pipe, the one not being connected to the sacrificial protective pipe, and a sacrificial protective material provided to the flow path component.

20 Claims, 8 Drawing Sheets

(56) References Cited

U.S. PATENT DOCUMENTS

| | | | | |
|---|---|---|---|---|
| 2015/0316258 | A1* | 11/2015 | Staller | F23J 11/08 454/1 |
| 2019/0186432 | A1* | 6/2019 | Kim | F02M 26/30 |
| 2019/0309675 | A1* | 10/2019 | Nishiyama | B23K 1/008 |
| 2019/0387604 | A1* | 12/2019 | Fandrich | H05H 1/2406 |

FOREIGN PATENT DOCUMENTS

| | | | |
|---|---|---|---|
| JP | 60-030420 | Y | 9/1985 |
| JP | 2019090362 | A | 6/2019 |
| KR | 102215070 | B1 | 2/2021 |

* cited by examiner

ENGINE

CROSS-REFERENCE TO RELATED APPLICATIONS

This application claims priority under 35 U.S.C. § 119 to JP Application No. 2022-023514 filed Feb. 18, 2022, the entire contents of which are hereby incorporated by reference.

TECHNICAL FIELD

The present invention relates to an engine.

BACKGROUND ART

When components of a marine engine are cooled with seawater, a cooling pipe through which seawater flows may corrode. Therefore, a technology for preventing corrosion of a cooling pipe has been conventionally studied. For example, Patent Document 1 describes placing an anticorrosive zinc in an intercooler. Patent Document 2 describes forming an anticorrosive coating inside a cooling pipe.

PRIOR ART DOCUMENT

Patent Document

Patent Document 1: JP60-030420Y
Patent Document 2: JP-A-2019-90362

SUMMARY OF INVENTION

Technical Problem

An anticorrosive zinc and an anticorrosive coating deteriorate due to use over the long-term. Therefore, periodic replacement is required. However, a bolt-type anticorrosive zinc has a small surface area and therefore reduces in thickness quickly and needs to be replaced frequently. A conceivable way to reduce the frequency of replacement is to use a large anticorrosive zinc. However, in order to do so, it is necessary to increase the diameter of the pipe. Hence, there are problems such as an increase in the cost of the components and an increase in the degree of difficulty in the placement of the components. On the other hand, when a cooling pipe in which an anticorrosive coating is formed is used, there is a problem that the replacement work is more extensive than that of the anticorrosive zinc.

Considering the above circumstances, an object of the present invention is to provide an engine that can reduce the burden of maintenance for preventing corrosion of a pipe.

Solution to Problem

In order to solve the above problem, an engine according to the present invention includes: a sacrificial protective pipe subjected to a sacrificial protective coating process; and a metal pipe connected to at least one of two ends of the sacrificial protective pipe.

The engine may include: a flow path component connected to one of two ends of the metal pipe, the one not being connected to the sacrificial protective pipe; and a sacrificial protective material provided to the flow path component.

The sacrificial protective pipe, the metal pipes, and the flow path components each including the sacrificial protective material may be connected in an order of the flow path component including the sacrificial protective material, the metal pipe, the sacrificial protective pipe, the metal pipe, and the flow path component including the sacrificial protective material.

The plurality of metal pipes may have a same shape.

The sacrificial protective pipe may be connected to the metal pipe via a connecting pipe, and the connecting pipe may be slidable along a longitudinal direction of the metal pipe or the sacrificial protective pipe.

The sacrificial protective coating process may be a galvanizing process, and the metal pipe may be formed of iron.

The engine may include: a flow path component connected to one of two ends of the metal pipe, the one not being connected to the sacrificial protective pipe; and a sacrificial protective material provided to the flow path component, in which the sacrificial protective material may be formed of zinc or iron.

Advantageous Effects of Invention

According to the present invention, it is possible to reduce the burden of maintenance for preventing corrosion of a pipe.

DESCRIPTION OF EMBODIMENTS

An engine 100 according to an embodiment of the present invention is described hereinafter with reference to the drawings.

Figure 1:
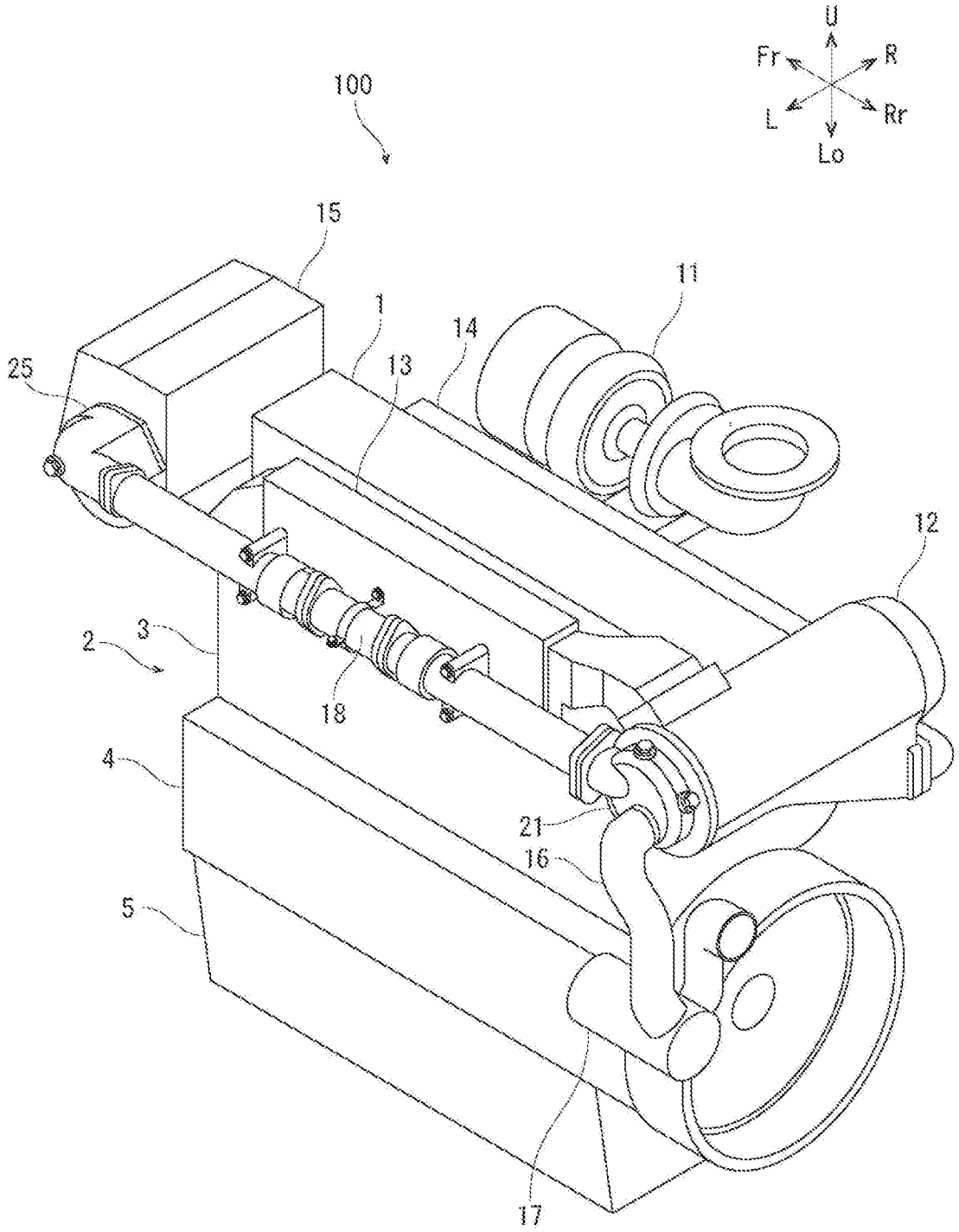
FIG. 1 is a perspective view illustrating an engine according to an embodiment of the present invention.

First, the entire configuration of the engine 100 is described. FIG. 1 is a perspective view illustrating the engine 100. In the drawings, U, Lo, L, R, Fr, and Rr denote up, down, left, right, front, and back, respectively. An example in which a cylinder head 1 is provided on top of a cylinder block 2 appears in the embodiment. However, the engine 100 may be used in any attitude. Moreover, an inline-six diesel engine appears, as an example of an application target of the present invention, in the embodiment. However, the present invention is suitable for all reciprocating engines with a plurality of cylinders.

The engine 100 includes the cylinder head 1, the cylinder block 2, and an oil pan 5. In the cylinder head 1, six component groups (not illustrated) including an air intake path, an exhaust path, an intake valve, an exhaust valve, and an injector are placed in series along a front-and-back direction. The cylinder block 2 includes: a cylinder row 3 in which six cylinders (not illustrated) housing a piston and a connecting rod are placed in series along the front-and-back direction; and a crankcase 4 housing a crankshaft (not illustrated). The oil pan 5 stores lubricating oil.

Figure 2:
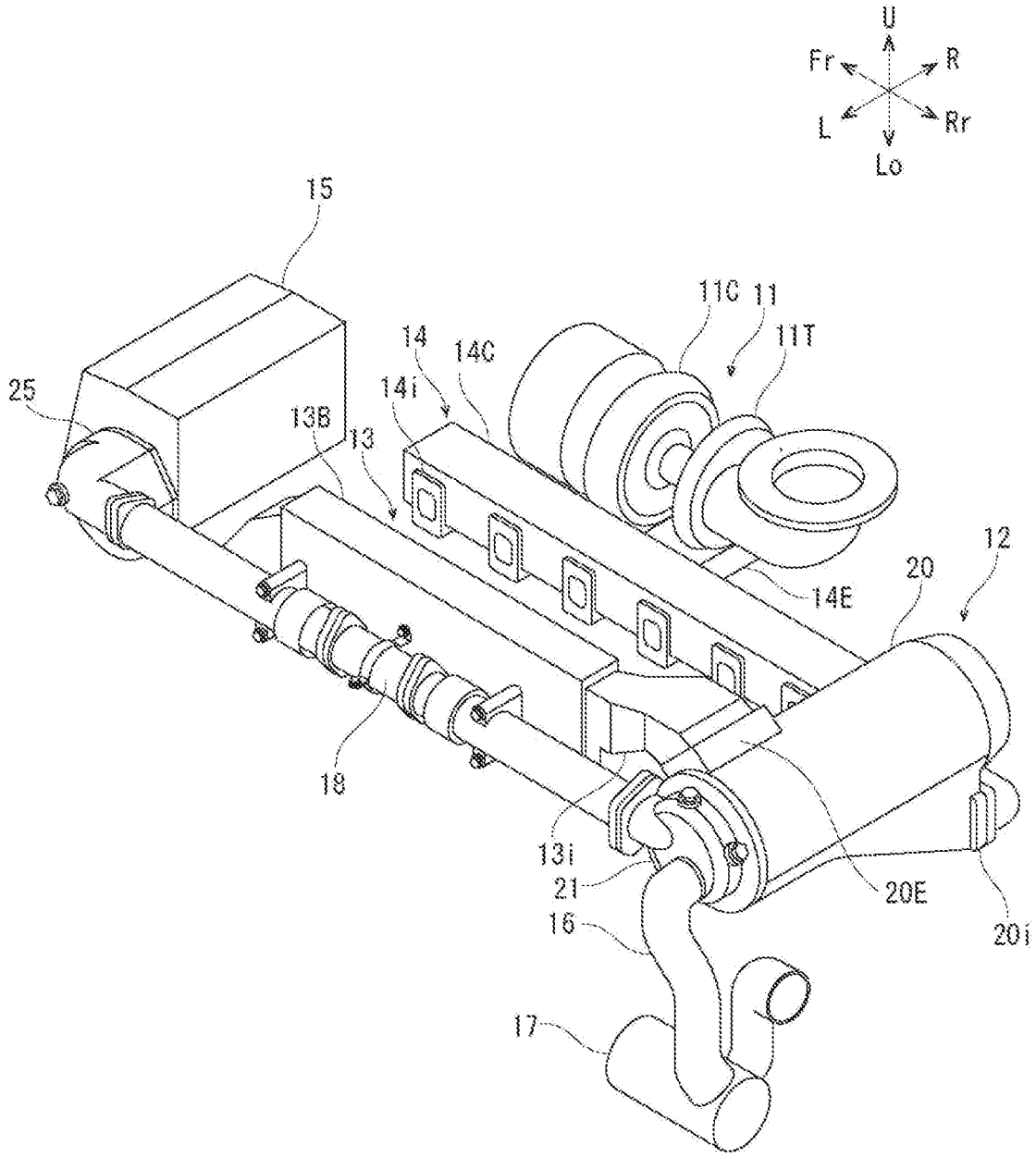
FIG. 2 is a perspective view illustrating air intake and exhaust paths according to the embodiment of the present invention.
Figure 3:
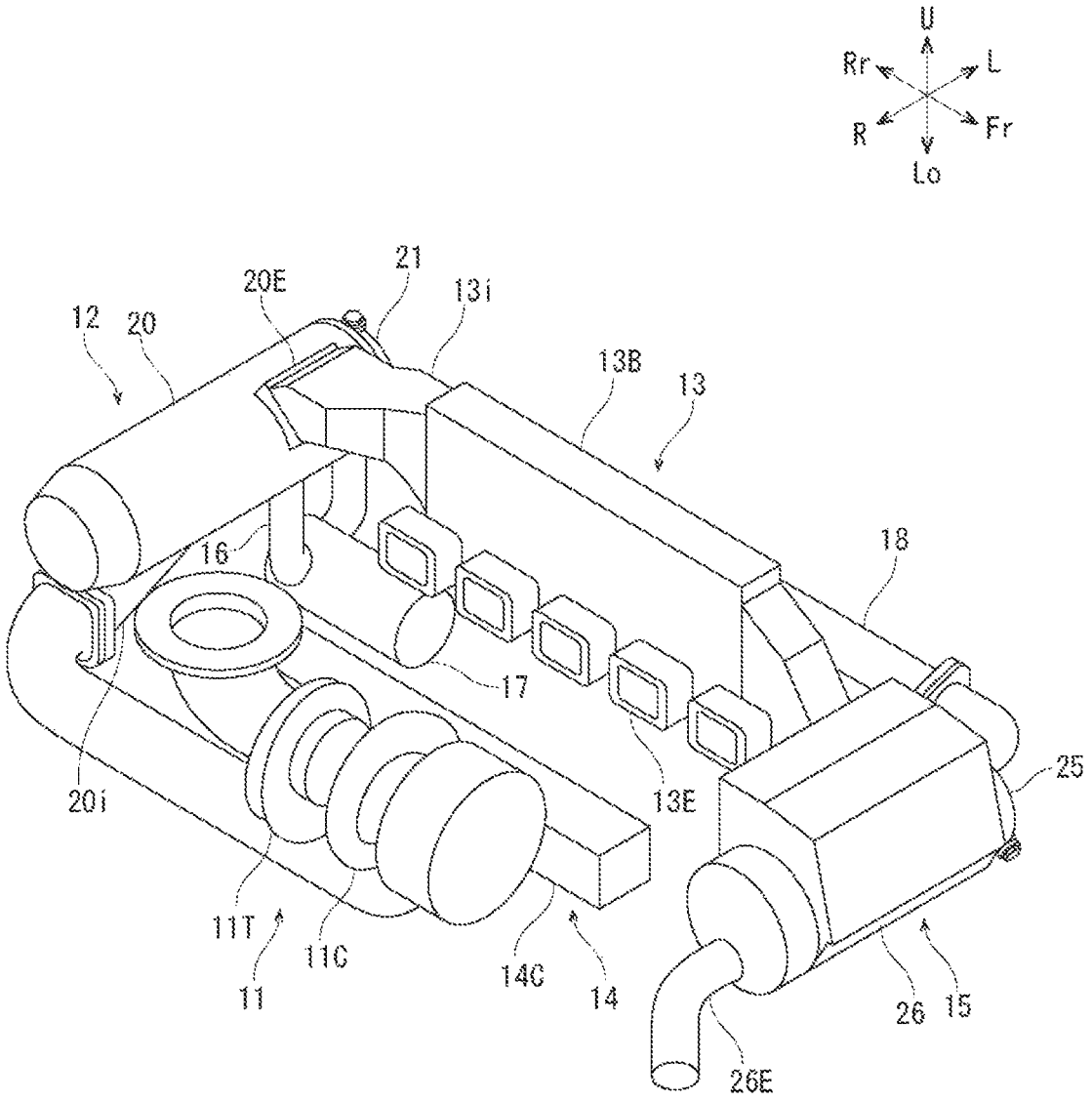
FIG. 3 is a perspective view illustrating the air intake and exhaust paths according to the embodiment of the present invention.

Next, air intake and exhaust paths are described. FIGS. 2 and 3 are perspective views illustrating the air intake and exhaust paths. The air intake and exhaust paths include a turbocharger 11, an intercooler 12, an intake manifold 13, the cylinder head 1, and an exhaust manifold 14.

The turbocharger 11 includes a turbine 11T and a compressor 11C. The compressor 11C is connected to the intercooler 12. The intake manifold 13 includes a main body portion 13B, an air intake inlet port 13*i*, and six air intake passages 13E. The air intake inlet port 13*i* is connected to the intercooler 12. The six air intake passages 13E are connected to the air intake path (not illustrated) of the cylinder head 1. The exhaust manifold 14 includes a collector 14C, six exhaust inlet ports 14*i*, and an exhaust outlet port 14E. The six exhaust inlet ports 14*i* are connected to the exhaust path (not illustrated) of the cylinder head 1. The exhaust outlet port 14E is connected to the turbine 11T.

Exhaust gases from the cylinders are supplied to the turbine 11T through the exhaust path of the cylinder head 1 and the exhaust manifold 14. The turbine 11T rotates by exhaust energy. The compressor 11C rotates together with the turbine 11T to take in and compress air. The compressed air is sent to the intercooler 12. The intercooler 12 cools the compressed air and sends the compressed air to the intake manifold 13. The intake manifold 13 has a function of a surge tank that equalizes the density, intake volume, and stream of the compressed air supplied to each cylinder, and supplies the compressed air to the air intake path of the cylinder head 1 through the air intake passages 13E.

Figure 4:
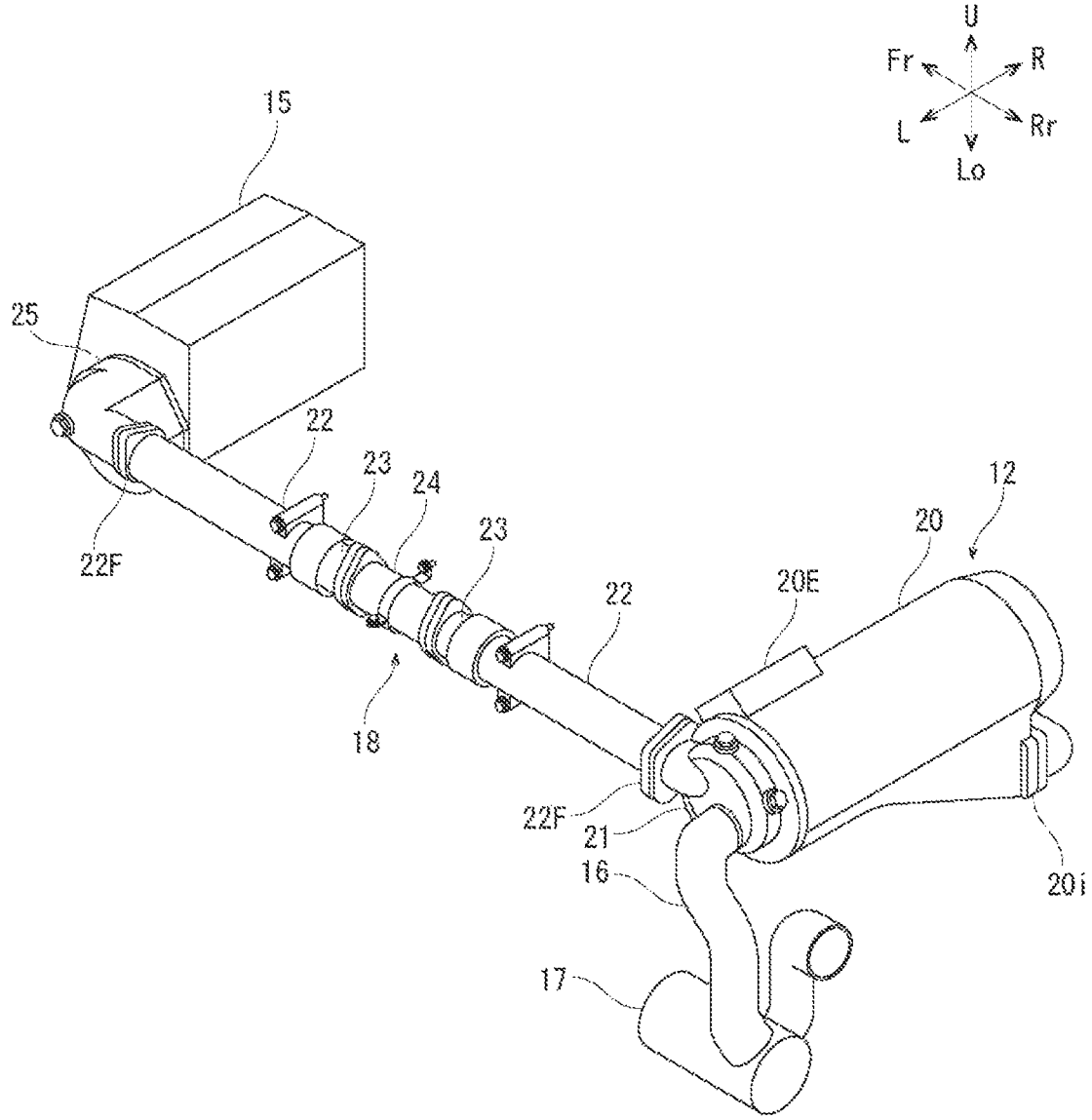
FIG. 4 is a perspective view illustrating a cooling pipe according to the embodiment of the present invention.

Next, an outline of a cooling pipe 18 is described. FIG. 4 is a perspective view illustrating the cooling pipe 18. A feed water pipe 16 including a pump 17 is connected to the intercooler 12. The intercooler 12 cools intake air with seawater sucked up by the pump 17. A fresh-water cooler 15 is connected to the intercooler 12 via the cooling pipe 18. The seawater used to cool the intake air in the intercooler 12 is supplied to the fresh-water cooler 15 through the cooling pipe 18. The fresh-water cooler 15 cools coolant circulating in a water jacket (not illustrated) provided to the engine 100, with the seawater supplied from the intercooler 12. The seawater used to cool the coolant in the fresh-water cooler 15 is used to cool the lubricating oil in an oil cooler (not illustrated) and then discharged to the outside of the ship.

Figure 5:
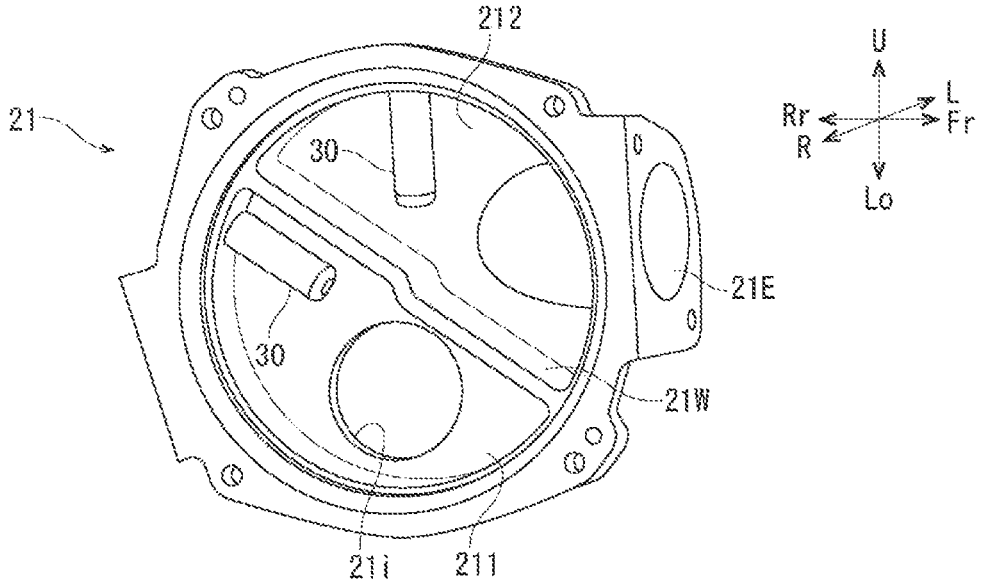
FIG. 5 is a perspective view illustrating an intercooler side cover according to the embodiment of the present invention.
Figure 6:
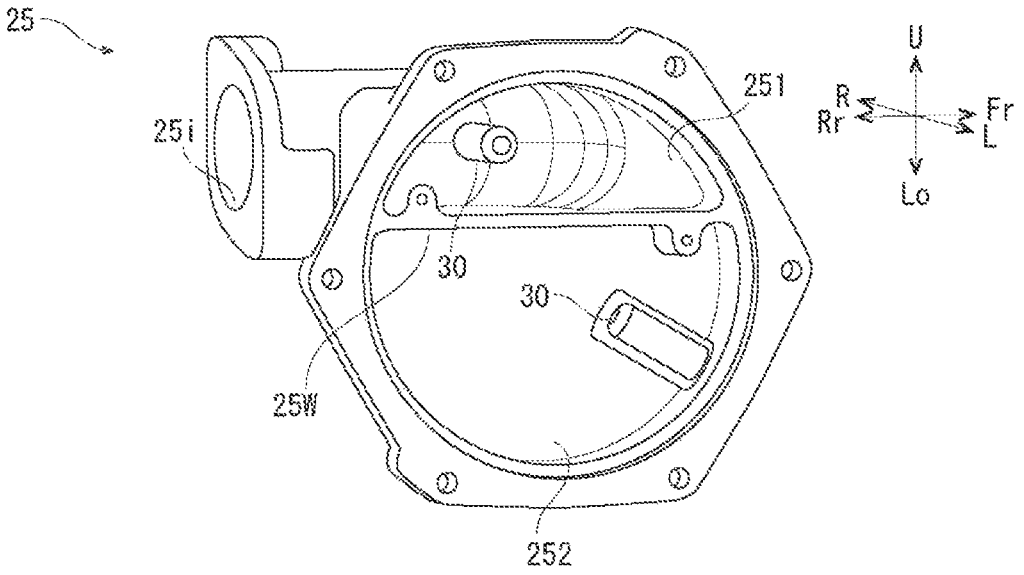
FIG. 6 is a perspective view illustrating a fresh-water cooler side cover according to the embodiment of the present invention.
Figure 7:
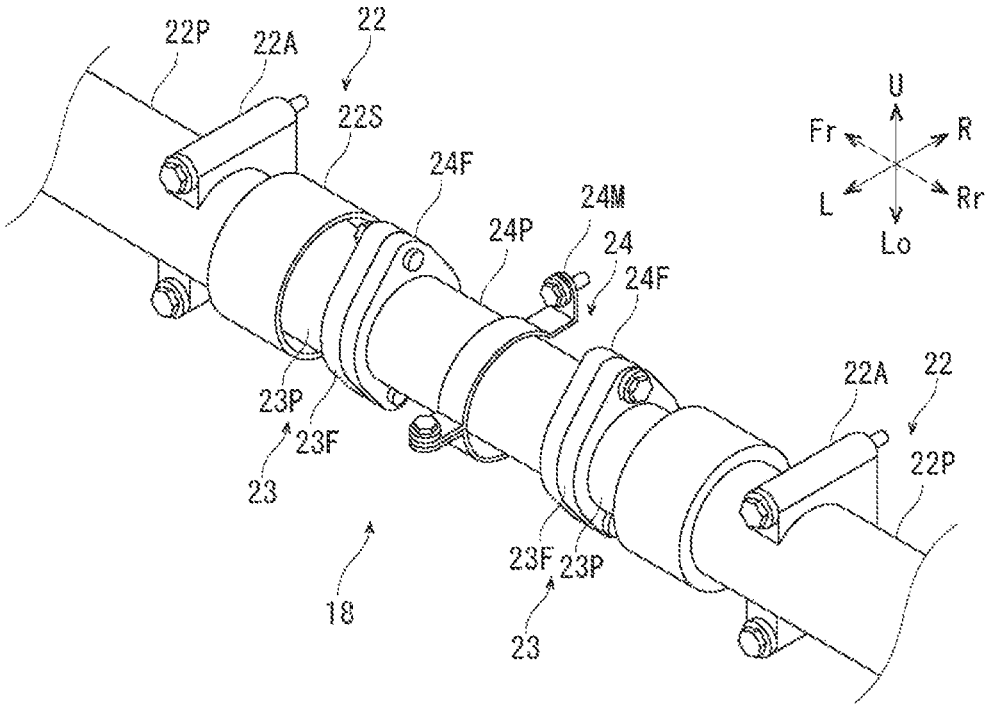
FIG. 7 is a perspective view illustrating the main elements of the cooling pipe according to the embodiment of the present invention.
Figure 8:
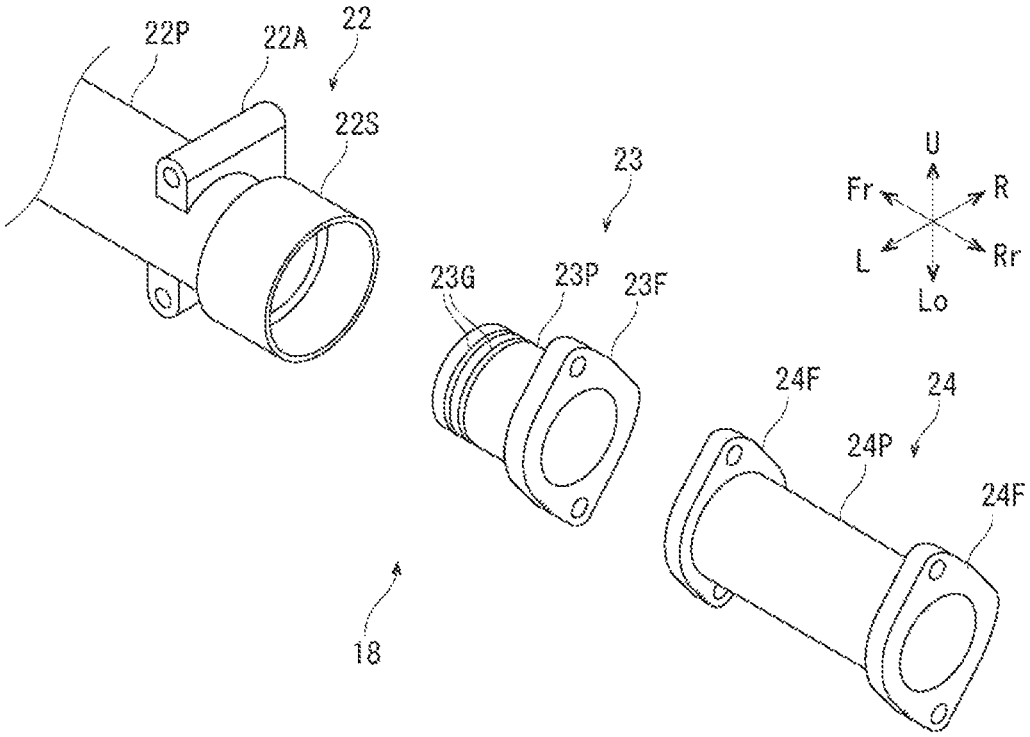
FIG. 8 is an exploded view illustrating the main elements of the cooling pipe according to the embodiment of the present invention.
Figure 9:
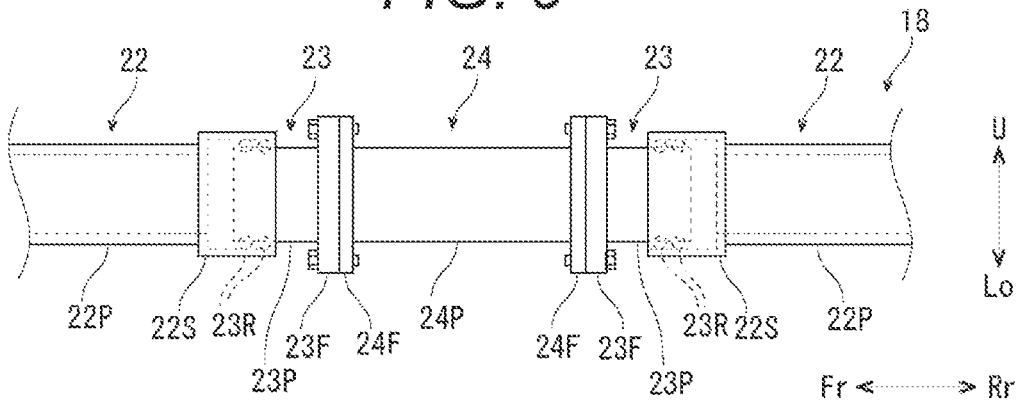
FIG. 9 is a side view illustrating the main elements of the cooling pipe according to the embodiment of the present invention.

Next, the cooling pipe 18 is described in detail. FIG. 5 is a perspective view illustrating an intercooler side cover 21. FIG. 6 is a perspective view illustrating a fresh-water cooler side cover 25. FIG. 7 is a perspective view illustrating the main elements of the cooling pipe 18. FIG. 8 is an exploded view illustrating the main elements of the cooling pipe 18. FIG. 9 is a side view illustrating the main elements of the cooling pipe 18. In FIG. 7, connecting pipes 23 and metal pipes 22 are provided in front of and behind a sacrificial protective pipe 24. However, in FIG. 8, only the sacrificial protective pipe 24, and the connecting pipe 23 and the metal pipe 22 that are in front of the sacrificial protective pipe 24 are illustrated.

The engine 100 includes the sacrificial protective pipe 24 that has been subjected to a sacrificial protective coating process, and the metal pipe 22 connected to at least one of two ends of the sacrificial protective pipe 24.

The intercooler 12 (refer to FIGS. 4 and 5) includes an intercooler housing 20 and the intercooler side cover 21 (an example of a flow path component) that blocks an opening (not illustrated) provided in the left side of the intercooler housing 20.

The intercooler housing 20 includes an air intake inlet port 20*i* and an air intake outlet port 20E. The air intake inlet port 20*i* is provided in a portion on the right side of the bottom of the intercooler housing 20. The air intake outlet port 20E is provided in a portion that is further to the left than the center of the intercooler housing 20 in the left-and-right direction. The air intake outlet port 20E opens to the front and upward.

The intercooler side cover 21 is substantially circular and recessed leftward. A space inside the intercooler side cover 21 is divided by a partition wall 21W into a first auxiliary chamber 211 on the bottom and a second auxiliary chamber 212 on the top. The first auxiliary chamber 211 is provided with a liquid inlet port 21*i* penetrating in the left-and-right direction. The liquid inlet port 21*i* is connected to the feed water pipe 16. The second auxiliary chamber 212 is provided with a liquid outlet port 21E penetrating in the front-and-back direction. The liquid outlet port 21E is connected to the back end of the cooling pipe 18. The first auxiliary chamber 211 and the second auxiliary chamber 212 are each provided with an insertion port (not illustrated) penetrating from the inside through to the outside. A female thread is formed in each of the insertion ports. A bolt-shaped sacrificial protective material 30 with a male thread is mounted in the each of the insertion ports. The sacrificial protective material 30 protrudes from the inner surface of each of the first auxiliary chamber 211 and the second auxiliary chamber 212. The sacrificial protective material 30 is formed of zinc or iron. Zinc that contains, as a main raw material, high-purity zinc metal with a purity equal to or greater than 99.99% is used. Iron that is pure iron with a purity equal to or greater than 99.90% is used.

The fresh-water cooler 15 (refer to FIGS. 4 and 6) includes a fresh-water cooler housing 26 and the fresh-water cooler side cover 25 (an example of the flow path component) that blocks an opening (not illustrated) provided in the left side of the fresh-water cooler housing 26. The fresh-water cooler side cover 25 is substantially circular and recessed leftward. A space inside the fresh-water cooler side cover 25 is divided by a partition wall 25W into a first auxiliary chamber 251 on the top and a second auxiliary chamber 252 on the bottom. The first auxiliary chamber 251 is provided with a liquid inlet port 25*i* penetrating in the front-and-back direction. The liquid inlet port 25*i* is connected to the front end of the cooling pipe 18. The first auxiliary chamber 251 and the second auxiliary chamber 252 are each provided with an insertion port (not illustrated) penetrating from the inside through to the outside. A female thread is formed in each of the insertion ports. The above-mentioned sacrificial protective material 30 is mounted in the each of the insertion ports. The sacrificial protective material 30 protrudes from the inner surface of each of the first auxiliary chamber 251 and the second auxiliary chamber 252.

The cooling pipe 18 (refer to FIGS. 4 and 7 to 9) includes the metal pipes 22 and the sacrificial protective pipe 24. Seawater flows from the intercooler 12 to the fresh-water cooler 15 through the cooling pipe 18. The metal pipes 22, the sacrificial protective pipe 24, the intercooler side cover 21, and the fresh-water cooler side cover 25 are placed in the order of the intercooler side cover 21, the metal pipe 22, the sacrificial protective pipe 24, the metal pipe 22, and the fresh-water cooler side cover 25 from the back.

The metal pipes 22 are formed of iron. Sacrificial protective coatings are not formed on the inner peripheral surfaces of the metal pipes 22. The metal pipes 22 in front of and behind the sacrificial protective pipe 24 have the same shape. Specifically, the metal pipes 22 are at least configured in such a manner as to have a common shape at two ends of each of the metal pipes 22 and a common length and to be interchangeable as a cooling water pipe. As long as being interchangeable as a cooling water pipe, the metal pipes 22 are regarded as having the same shape even if the shape and placement of a boss formed on the pipe surface are different. The each of the metal pipes 22 includes a pipe portion 22P, a flange 22F provided at one end of the pipe portion 22P in the front-and-back direction, and a sleeve 22S provided at the other end of the pipe portion 22P. The inner diameter of the sleeves 22S is greater than the inner diameter of the pipe portions 22P. The flange 22F of the metal pipe 22 near the intercooler 12 is fastened to the liquid outlet port 21E of the intercooler side cover 21 by a bolt via a gasket or an O-ring (neither illustrated). The flange 22F of the metal pipe 22 near the fresh-water cooler 15 is fastened to the liquid inlet port 25*i* of the fresh-water cooler side cover 25 by a bolt via a gasket or an O-ring (neither illustrated).

A bolt insertion portion 22A is provided in the vicinity of an end of the pipe portion 22P of the each of the metal pipes 22, the end being near the respective sleeve 22S (refer to FIGS. 7 and 8). Each of the bolt insertion portions 22A is a portion expanding upward and downward from the outer peripheral surface of the respective pipe portion 22P. The each of the bolt insertion portions 22A is provided with a bolt hole penetrating in the left-and-right direction. A female thread is provided in the left side surface of the main body portion 13B of the intake manifold 13, in a position corresponding to each of the bolt holes of the bolt insertion portions 22A (not illustrated). The metal pipes 22 are fastened to the intake manifold 13 by bolts to be fixed to the intake manifold 13 (refer to FIG. 2).

The sacrificial protective pipe 24 is formed of iron. The sacrificial protective pipe 24 includes a pipe portion 24P, and a flange 24F provided at each end of the pipe portion 24P. The inner surface of the sacrificial protective pipe 24 has been subjected to a galvanizing process such as hot-dip galvanizing or electrogalvanizing. Zinc that contains, as a main raw material, high-purity zinc metal with a purity equal to or greater than 99.99% is used.

The metal pipes 22 and the sacrificial protective pipe 24 are connected together by the connecting pipes 23. Each of the connecting pipes 23 includes a pipe portion 23P, and a flange 23F provided at one end of the pipe portion 23P in the front-and-back direction. A groove 23G in which an O-ring 23R (refer to FIG. 9) fits along the circumferential direction is provided in the outer peripheral surface at the other end of each of the pipe portions 23P. When the other ends of the connecting pipes 23 are inserted into the sleeves 22S of the metal pipes 22, the O-rings 23R are pressed against the inner peripheral surfaces of the sleeves 22S, thereby preventing the leakage of seawater. The connecting pipes 23 are slidable in the front-and-back direction along the inner peripheral surfaces of the sleeves 22S. The flanges 23F of the connecting pipes 23 are fastened to the flanges 24F of the sacrificial protective pipe 24 by bolts via gaskets or O-rings (neither illustrated).

The sacrificial protective pipe 24 is fixed to the intake manifold 13 by a fixing member 24M (refer to FIGS. 2 and 7). The fixing member 24M is, for example, a metal band. In this example, the fixing member 24M includes two bands coupled by a bolt and a nut, but may include one band. The fixing member 24M is wrapped around the pipe portion 24P of the sacrificial protective pipe 24. Each end of the fixing member 24M in the longitudinal direction is bent along the left side surface of the main body portion 13B of the intake manifold 13, and includes a bolt hole penetrating in the left-and-right direction. A female thread is provided in the left side surface of the main body portion 13B of the intake manifold 13, in each of positions corresponding to the bolt holes of the fixing member 24M (not illustrated). The sacrificial protective pipe 24 is fastened to the intake manifold 13 by a bolt to be fixed to the intake manifold 13.

The seawater that has flown from the feed water pipe 16 into the first auxiliary chamber 211 through the liquid inlet port 21*i* of the intercooler side cover 21 cools the compressed air while flowing along a flow path (not illustrated) in the intercooler housing 20, and flows from the second auxiliary chamber 212 into the cooling pipe 18 through the liquid outlet port 21E. The seawater that has flown from the cooling pipe 18 into the first auxiliary chamber 251 through the liquid inlet port 25*i* of the fresh-water cooler side cover 25 flows into the second auxiliary chamber 252 over the partition wall 25W, cools the coolant while flowing along a flow path (not illustrated) in the fresh-water cooler 15, and is discharged to the outside of the ship through a liquid outlet port 26E and the oil cooler (not illustrated).

Figure 10:
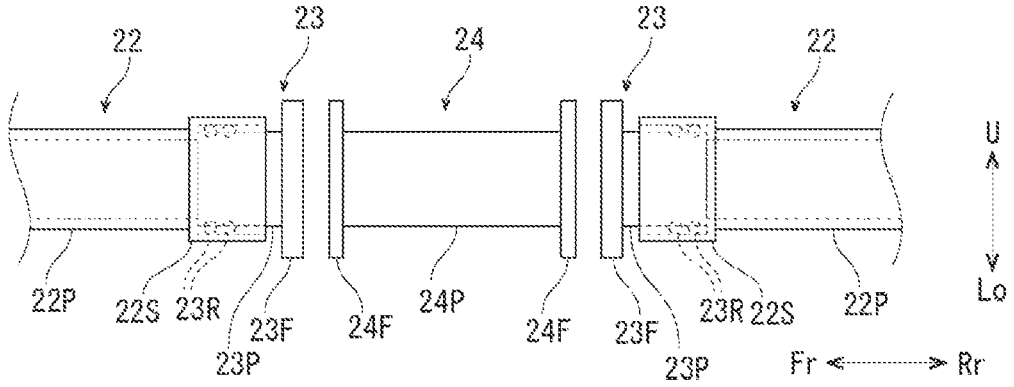
FIG. 10 is a side view illustrating a procedure for replacing a sacrificial protective pipe according to the embodiment of the present invention.
Figure 11:
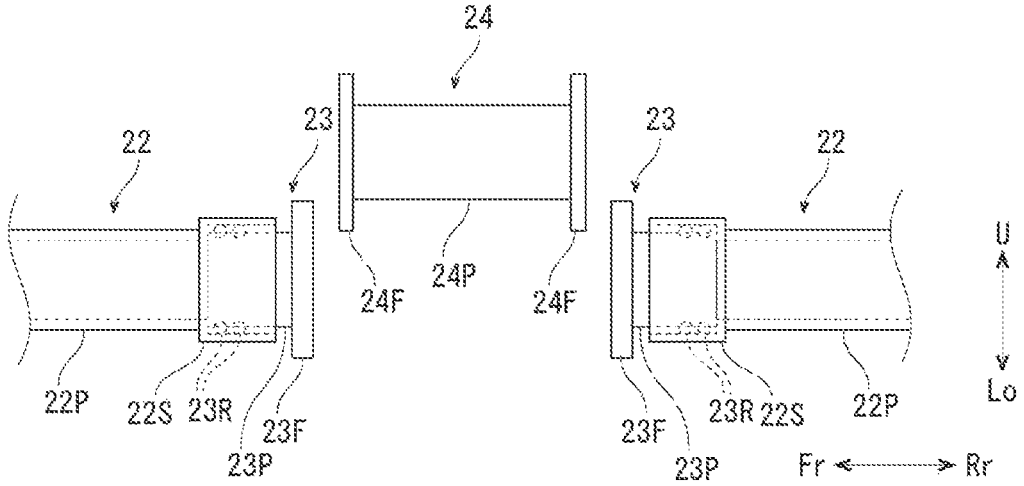
FIG. 11 is a side view illustrating the procedure for replacing the sacrificial protective pipe according to the embodiment of the present invention.

Next, a procedure for replacing the sacrificial protective pipe 24 is described (refer to FIGS. 9 to 11). FIGS. 10 and 11 are side views illustrating the procedure for replacing the sacrificial protective pipe 24. In FIGS. 9 to 11, the bolt insertion portions 22A and the fixing member 24M are not illustrated.

FIG. 9 illustrates a state in which the sacrificial protective pipe 24 is connected to the metal pipes 22 via the connecting pipes 23. The flanges 23F of the connecting pipes 23 are fastened to the flanges 24F of the sacrificial protective pipe 24, respectively. The O-rings 23R are in contact with the inner peripheral surfaces of the sleeves 22S in areas near the sacrificial protective pipe 24.

When the sacrificial protective pipe 24 is replaced, the fixing member 24M is removed first, and then the bolts by which the flanges 24F of the sacrificial protective pipe 24 and the flanges 23F of the connecting pipes 23 are fastened are removed.

Next, the connecting pipes 23 are slid toward the metal pipes 22, respectively, while holding the sacrificial protective pipe 24 (refer to FIG. 10), and the sacrificial protective pipe 24 is taken out (refer to FIG. 11). The O-rings 23R are in contact with the inner peripheral surfaces of the sleeves 22S in areas near the pipe portions 22P. If gaskets or O-rings are secured to the flanges 23F of the connecting pipes 23, the gaskets or O-rings are removed. In this example, the front and back connecting pipes 23 are slid toward the metal pipes 22, respectively. However, only one of the connecting pipes 23 may be slid. Moreover, the fixing member 24M may be removed after the connecting pipes 23 are slid toward the metal pipes 22. In this case, it is not necessary to hold the sacrificial protective pipe 24.

Next, the sacrificial protective pipe 24 for replacement is held between the front and back connecting pipes 23 (refer to FIG. 10), and the front and back connecting pipes 23 are slid toward the sacrificial protective pipe 24. At this point in time, gaskets or O-rings (neither illustrated) are sandwiched respectively between the flanges 23F of the connecting pipes 23 and the flanges 24F of the sacrificial protective pipe 24. Moreover, it is desirable to adjust the positions of the connecting pipes 23 in such a manner that the sacrificial protective pipe 24 is equidistant from the front and back metal pipes 22. Lastly, the flanges 23F of the connecting pipes 23 and the flanges 24F of the sacrificial protective pipe 24 are fastened by bolts, and the fixing member 24M is mounted.

The engine 100 according to the embodiment described above includes the sacrificial protective pipe 24 that has been subjected to the sacrificial protective coating process, and the metal pipe 22 connected to at least one of two ends of the sacrificial protective pipe 24. According to this configuration, maintenance for preventing corrosion of a pipe only requires the replacement of the sacrificial protective pipe 24 alone, and there is no need to replace the metal pipe 22. Moreover, the sacrificial protective pipe 24 has a longer-lasting corrosion prevention effect than an anticorrosive zinc; therefore, the replacement frequency can be reduced. Hence, it is possible to reduce the burden of maintenance for preventing corrosion of a pipe. Moreover, a space for installing an anticorrosive zinc is not required; therefore, the pipe can be made compact.

Moreover, the engine 100 according to the embodiment includes the flow path component (the intercooler side cover 21, the fresh-water cooler side cover 25) connected to one of two ends of the metal pipe 22, the one not being connected to the sacrificial protective pipe 24, and the sacrificial protective material 30 provided to the flow path component. According to this configuration, the metal pipe 22 is sandwiched between the sacrificial protective pipe 24 and the sacrificial protective material 30; therefore, the corrosion prevention effect is enhanced. Hence, the replacement frequency of the metal pipe 22 can be reduced.

Moreover, in the engine 100 according to the embodiment, the sacrificial protective pipe 24, the metal pipes 22, and the flow path components each including the sacrificial protective material 30 are connected in the order of the flow path component including the sacrificial protective material 30, the metal pipe 22, the sacrificial protective pipe 24, the metal pipe 22, and the flow path component including the sacrificial protective material 30. According to this configuration, the corrosion prevention effect of the sacrificial protective pipe 24 extends to the upstream side and the downstream side; therefore, the range where the corrosion prevention effect can be further extended.

Moreover, in the engine 100 according to the embodiment, the plurality of metal pipes 22 have the same shape; therefore, the cost of the components can be reduced.

Moreover, in the engine 100 according to the embodiment, the sacrificial protective pipe 24 is connected to the metal pipe 22 via the connecting pipe 23, and the connecting pipe 23 is slidable along the longitudinal direction of the metal pipe 22 or the sacrificial protective pipe 24. Therefore, even if the sacrificial protective pipe 24 and the metal pipe 22 form a straight flow path, the sacrificial protective pipe 24 can be replaced without removing the metal pipe 22.

Moreover, in the engine 100 according to the embodiment, the sacrificial protective coating process is the galvanizing process, and the metal pipe 22 is formed of iron; therefore, corrosion can be prevented with a low-cost material.

Moreover, the engine 100 according to the embodiment includes the flow path component connected to one of two ends of the metal pipe 22, the one not being connected to the sacrificial protective pipe 24, and the sacrificial protective material 30 provided to the flow path component. The sacrificial protective material 30 is formed of zinc or iron; therefore, corrosion can be prevented with a low-cost material.

The above embodiment may be modified as follows:

In the above embodiment, seawater appears as an example of a liquid flowing through the metal pipes 22. However, the liquid may be fresh water, tap water, or the like. For example, the present invention may be applied to a configuration in which the grounded engine 100 for power generation on land is cooled with fresh water or tap water that is stored in a pit. Moreover, the liquid may be other than water, and may be any substance as long as the substance contains a component that corrodes the metal pipes 22.

The intercooler 12, the fresh-water cooler 15, and the oil cooler appear as examples of devices that are connected to the cooling pipe 18 in the above embodiment. However, the devices that are connected to the cooling pipe 18 may be any devices as long as the devices cool the engine components with a liquid.

The example in which the intercooler 12 is placed behind, and the fresh-water cooler 15 in front of, the engine 100 appears in the above embodiment. However, the fresh-water cooler 15 may be placed behind, and the intercooler 12 in front of, the engine 100. Moreover, the example in which seawater is supplied from the intercooler 12 to the fresh-water cooler 15 appears in the above embodiment. However, seawater may be supplied from the fresh-water cooler 15 to the intercooler 12.

The example in which the sacrificial protective pipe 24, the metal pipes 22, and the flow path components are placed in the order of the flow path component, the metal pipe 22, the sacrificial protective pipe 24, the metal pipe 22, and the flow path component from the back appears in the above embodiment. However, the flow path component, the metal pipe 22, the sacrificial protective pipe 24, and the flow path component may be placed in this order from the back. Moreover, the flow path component, the sacrificial protective pipe 24, the metal pipe 22, and the flow path component may be placed in this order from the back. In short, it is simply required that the metal pipe 22 is connected to at least one of the two ends of the sacrificial protective pipe 24.

The example in which the sacrificial protective material 30 is provided to the flow path component appears in the above embodiment. However, the sacrificial protective material 30 may not be provided to the flow path component.

The example in which the plurality of metal pipes 22 has the same shape appears in the above embodiment. However, the plurality of metal pipes 22 may have different shapes from each other.

The examples in which the sacrificial protective coating is hot-dip galvanizing, and the sacrificial protective material 30 is zinc or iron appear in the above embodiment. However, the sacrificial protective coating and the sacrificial protective material 30 are simply required to be substances having a higher ionization tendency than the metal pipe 22. For example, the sacrificial protective coating may be hot-dip aluminizing. Moreover, the sacrificial protective material 30 may be formed of aluminum. Moreover, the metal pipe 22 may be made of, for example, stainless steel.

Figure 12:
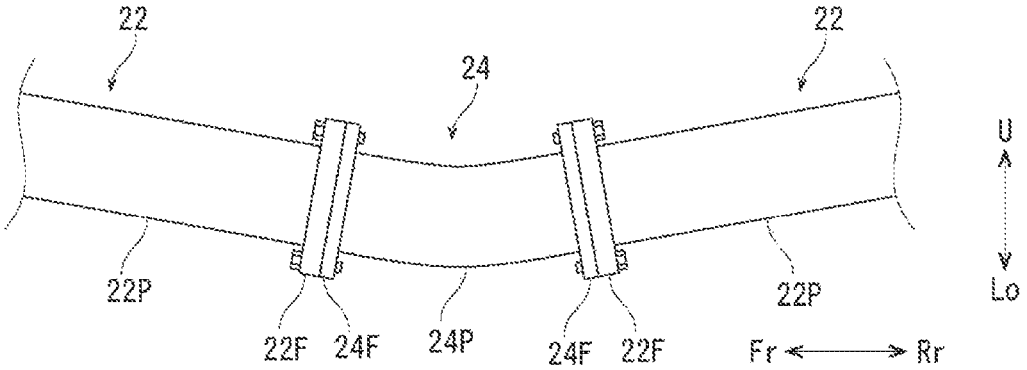
FIG. 12 is a side view illustrating a sacrificial protective pipe according to a modification of the embodiment of the present invention.
Figure 13:
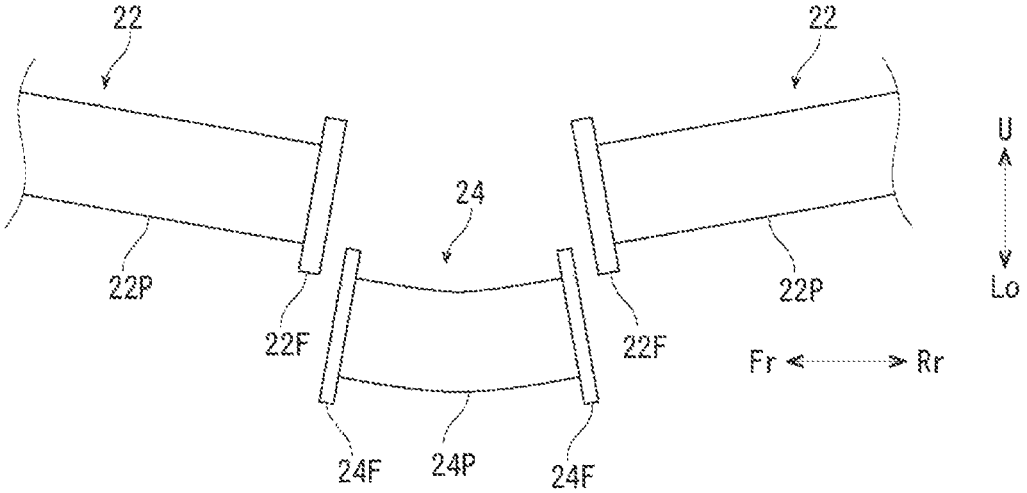
FIG. 13 is a side view illustrating a state where the sacrificial protective pipe according to the modification of the embodiment of the present invention has been removed.

FIG. 12 is a side view illustrating a cooling pipe 18 according to a modification. FIG. 13 is a side view illustrating a state in which a sacrificial protective pipe 24 has been removed from the cooling pipe 18 according to the modification. In this example, front and back metal pipes 22 are placed in such a manner that axes thereof intersect each other. The sacrificial protective pipe 24 is curved in such a manner as to smoothly connect the front and back metal pipes 22. The metal pipes 22 each include a flange 22F coupled to one of flanges 24F of the sacrificial protective pipe 24. According to this configuration, even if connecting pipes 23 are not provided, the sacrificial protective pipe 24 can be replaced without removing the metal pipes 22.

LIST OF REFERENCE SIGNS

100 Engine
21 Intercooler side cover (flow path component)
22 Metal pipe
23 Connecting pipe
24 Sacrificial protective pipe
25 Fresh-water cooler side cover (flow path component)
30 Sacrificial protective material

The invention claimed is:

1. An engine comprising:
a sacrificial protective pipe having a sacrificial protective coating;
a connecting pipe; and
a metal pipe connected to at least one of two ends of the sacrificial protective pipe via the connecting pipe.

2. The engine according to claim 1, comprising:
a flow path component connected to one of two ends of the metal pipe, the one not being connected to the sacrificial protective pipe; and
a sacrificial protective material provided to the flow path component.

3. The engine according to claim 2, wherein the sacrificial protective pipe, the metal pipe, and the flow path component including the sacrificial protective material are connected in an order of the flow path component including the sacrificial protective material, the metal pipe, the sacrificial protective pipe, another metal pipe, and another flow path component including the sacrificial protective material.

4. The engine according to claim 3, wherein:
the flow path component is an intercooler side cover; and
the other flow path component is a fresh-water cooler side cover.

5. The engine according to claim 3, wherein a plurality of metal pipes has a same shape, the plurality of metal pipes including the metal pipe and the other metal pipe.

6. The engine according to claim 1, wherein:
the connecting pipe includes a flange having at least one through hole configured to receive a bolt,
the flange of the connecting pipe configured to be coupled to a flange of the sacrificial protective pipe, and
the connecting pipe is slidable along a longitudinal direction of the metal pipe or the sacrificial protective pipe.

7. The engine according to claim 1, wherein:
the sacrificial protective coating includes aluminum, and
the metal pipe is formed of iron.

8. The engine according to claim 1, comprising:
a flow path component connected to one of two ends of the metal pipe, the one not being connected to the sacrificial protective pipe; and
a sacrificial protective material provided to the flow path component,
wherein the sacrificial protective material is formed of zinc or iron.

9. The engine according to claim 8, wherein the sacrificial protective material is formed of zinc.

10. The engine according to claim 8, wherein the sacrificial protective material is formed of iron.

11. The engine according to claim 1, wherein the sacrificial protective coating has a higher ionization tendency than the metal pipe.

12. The engine according to claim 1, wherein the sacrificial protective pipe is iron.

13. The engine according to claim 1, wherein each end of the sacrificial protective pipe includes a flange having at least one through hole configured to receive a bolt.

14. The engine according to claim 1, wherein the connecting pipe is slidable along a longitudinal direction of the metal pipe.

15. The engine according to claim 14, wherein the connecting pipe is distinct from the sacrificial protective pipe and from the metal pipe.

16. The engine according to claim 1, wherein the connecting pipe is slidable along a longitudinal direction of the sacrificial protective pipe.

17. The engine according to claim 1, further comprising a fixing member configured to connect the sacrificial protective pipe to an intake manifold of the engine.

18. The engine according to claim 17, wherein the fixing member includes a metal band and is coupled to the intake manifold by a bolt.

19. The engine according to claim 1, wherein an end of the metal pipe is configured as a sleeve, the sleeve configured to receive an end of the connecting pipe.

20. The engine according to claim 19, wherein an O-ring is positioned between the connecting pipe and the sleeve of the metal pipe.

* * * * *